US007075430B2

(12) United States Patent
Rolf et al.

(10) Patent No.: US 7,075,430 B2
(45) Date of Patent: Jul. 11, 2006

(54) SECURITY SYSTEM AND DANGER SENSOR FOR MONITORING DANGER PARAMETERS

(75) Inventors: Beckers Rolf, Volketswil (CH); Rene Lange, Gruningen (CH)

(73) Assignee: Siemens Building Technologies AG, Zurich (CH)

( * ) Notice: Subject to any disclaimer, the term of this patent is extended or adjusted under 35 U.S.C. 154(b) by 188 days.

(21) Appl. No.: 10/259,971

(22) Filed: Sep. 27, 2002

(65) Prior Publication Data

US 2004/0061611 A1 Apr. 1, 2004

(51) Int. Cl.
*G08B 13/08* (2006.01)

(52) U.S. Cl. ..... 340/545.3; 340/628; 340/332.1; 340/632; 340/539.26; 340/506; 340/511; 340/639.5; 340/568.1

(58) Field of Classification Search ..... 340/545.3, 340/628, 332, 691.1, 632, 870.3, 870.4, 539.1, 340/539.26, 541, 332.1, 506, 511, 693.5, 340/568.1
See application file for complete search history.

(56) References Cited

U.S. PATENT DOCUMENTS 4,803,473 A * 2/1989 Taylor ..... 340/693.5
5,155,469 A 10/1992 Hartmann et al. ..... 340/530
5,790,040 A * 8/1998 Kreier et al. ..... 340/693.1
6,114,955 A * 9/2000 Brunius et al. ..... 340/539.24
6,324,008 B1 * 11/2001 Baldwin et al. ..... 359/619
6,420,973 B1 * 7/2002 Acevedo ..... 340/628
6,593,857 B1 * 7/2003 Roper et al. ..... 340/870.3

FOREIGN PATENT DOCUMENTS

| | | |
|---|---|---|
| DE | 3910514 | 10/1990 |
| EP | 0707293 | 4/1996 |
| EP | 0834847 | 4/1996 |
| EP | 0786751 | 7/1997 |
| EP | 0803850 | 10/1997 |
| EP | 1227452 | 7/2002 |
| WO | 9524087 | 9/1995 |

* cited by examiner

*Primary Examiner*—Tai T. Nguyen
(74) *Attorney, Agent, or Firm*—Baker Botts LLP

(57) ABSTRACT

A security system utilizes danger sensors (3) and a central unit connected wirelessly to the danger sensors (3). The danger sensors (3) have a communication module (8) which has the same dimensions and same shape for all sensor types, and which is intended to attach the danger sensor (3) to a mounting plate (2). In addition to the communication module (8), the danger sensor (3) contains a detection module (9) where the communication module (8) has a mechanical and electrical/electronic interface with the detection module (9).

8 Claims, 3 Drawing Sheets

SECURITY SYSTEM AND DANGER SENSOR FOR MONITORING DANGER PARAMETERS

The present invention relates to a security system for monitoring danger parameters, comprising danger sensors, and with a central unit having a wireless connection to the danger sensors.

BACKGROUND OF THE INVENTION

Hard-wired security systems in which danger sensors are connected to a central unit via a two-wire line or a bus (see for example WO-A-95/24087), are well known. Wireless security systems are also known and are becoming increasingly common (see e.g. U.S. Pat. No. 5,155,469). Hybrid systems in which both types of communication, wired and wireless, are used (see for example EP-A-O 803 850), are also known.

A hard-wired connection guarantees a very high reliability of transfer, but makes the entire system relatively inflexible when seeking to accommodate changes in room designs and use. Such changes usually require the relocation of individual sensors which because of the necessary wiring can require extensive, disruptive and expensive installation work. The subsequent fitting of such security systems with wires in existing buildings, particularly in those in which no security system was originally provided, can be complex and expensive. This is particularly so in historic buildings.

Wireless security systems which have been used in private houses are known to be susceptible to faults, one attributing factor of which is the systems inadequate battery energy supply. This disadvantage however has been largely eliminated now that long-life batteries are available, and further because the power consumption of the radio sensors has been able to be reduced. Other causes of fault such as for example false alarms may also be reduced by alarm verification measures.

SUMMARY OF THE INVENTION

A wireless security system meeting modem requirements should also be suitable for use with danger sensors to monitor different danger parameters. Its production should be in expensive and its installation simple. Such a system should also be flexible, and allow the use of danger sensors for various danger parameters or danger sensors working on different protection principles. These objects and other objects are achieved according to the present invention, wherein the danger sensors have a communication module having the same dimensions and same shape for a variety of different alarm types, and the communication module is designed for fixing the danger sensor to a mounting plate.

In a preferred embodiment of the security system according to the present invention, each communication module is designed for connection with a detection module for danger parameters. The detection modules are provided for different danger parameters which can be connected to any communication module as required.

In another preferred embodiment of the security system according to the present invention, mounting plates are installed at specified points, and then the danger sensors are attached to the mounting plates by means of the communication module.

In a further preferred embodiment of the security system according to the present invention, the detection module is secured against unauthorized removal from the communication module.

In yet another preferred embodiment of the security system according to the present invention, the mounting plate has a straight guide for guarding against removal, and the danger sensor is fastened to the mounting plate by directing (pushing) the sensor vertically into the straight guide.

The use of a mounting plate and an identical communication module for different sensor types, and the use of this communication module for fixing the sensor to the mounting plate, has the essential advantage that for all sensors used in the system a single type of mounting plate can be used. This makes sensor installation very simple, and capable of being performed by relatively untrained staff, i.e., the installer of the sensor need not have any knowledge of security technology so that the sensor can be installed for example by a salesperson, an electrician, or, if sold in the building or do-it-yourself markets, by the purchaser. Since any detection module can be connected to each communication module, the security system according to the invention has maximum flexibility.

The present invention also relates to a danger sensor for a security system having wireless communication. The danger sensor comprises two modules, a communication module and a detection module. The communication module has mechanical and electrical/electronic interfaces with the detection module, and is intended for securing the danger sensor to a mounting plate. In a first preferred embodiment the said interface comprises a mechanical connection device and an electrical plug connection. In another preferred embodiment, the mechanical connection device has a straight guide and a stop which are designed and arranged so that on creation of the mechanical connection, an electrical plug connection is also created. In yet another preferred embodiment the said mechanical connection device is arranged on steps of the communication and detection modules which are designed to complement each other, and where in the installed state, the step of the detection module is covered towards the room to be monitored by the step of the communication module.

In another preferred embodiment of the present invention, guide means are included in the communication module which can be inserted in a corresponding straight guide of the mounting plate, and locking means are provided for fixing the sensor to the mounting plate.

Still another preferred embodiment of the danger sensor according to the present invention utilizes a contact switch arranged on the communication module which forms one part of a sabotage detector to trigger an alarm upon unauthorized removal of the danger sensor, or one of its modules from the wall.

In a further preferred embodiment of the danger sensor according to the present invention a web, which can be screwed to the wall bearing the mounting plate and broken away from the mounting plate, forms another part of the sabotage detector which in the installed state of the danger sensor closes the contact switch.

BRIEF DESCRIPTION OF THE DRAWINGS

The invention is described in greater detail below and with reference to an embodiment and drawings in which.

DETAILED DESCRIPTION OF THE INVENTION

Figure 1:
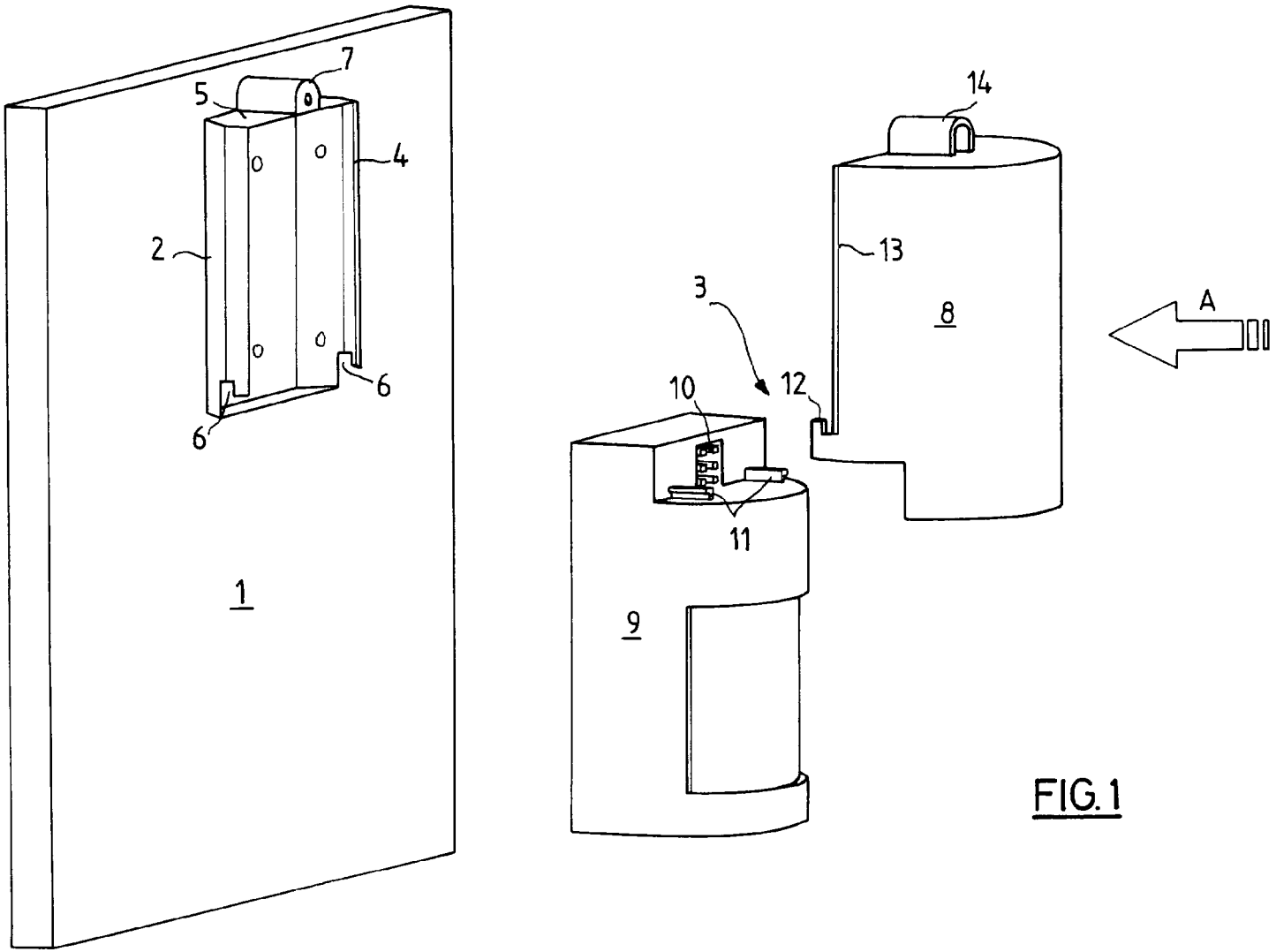
FIG. 1 illustrates a diagrammatic view of a mounting plate and the module of a danger sensor according to the invention before assembly and installation.
Figure 3:
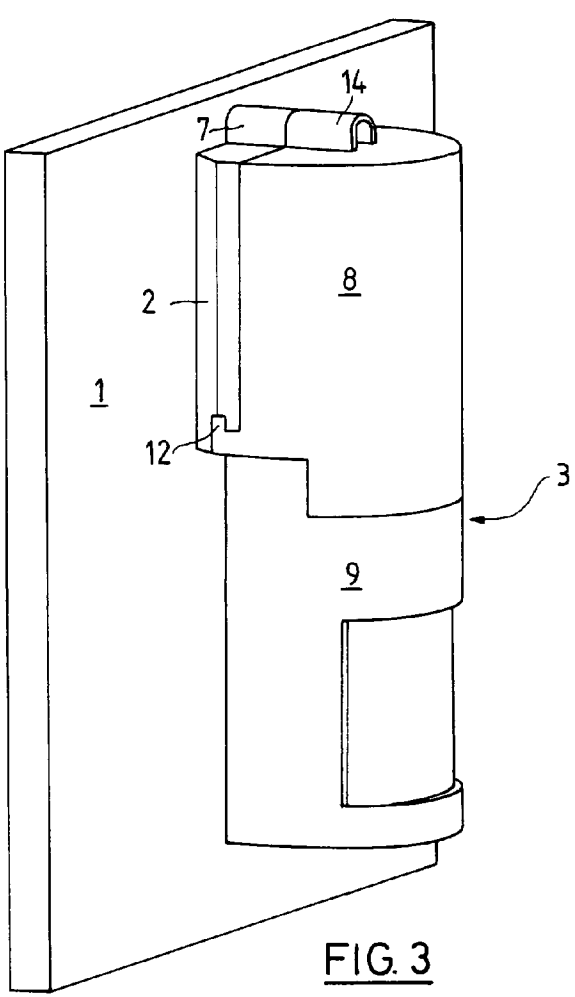
FIG. 3 illustrates the finished, installed danger sensor.
Figure 2:
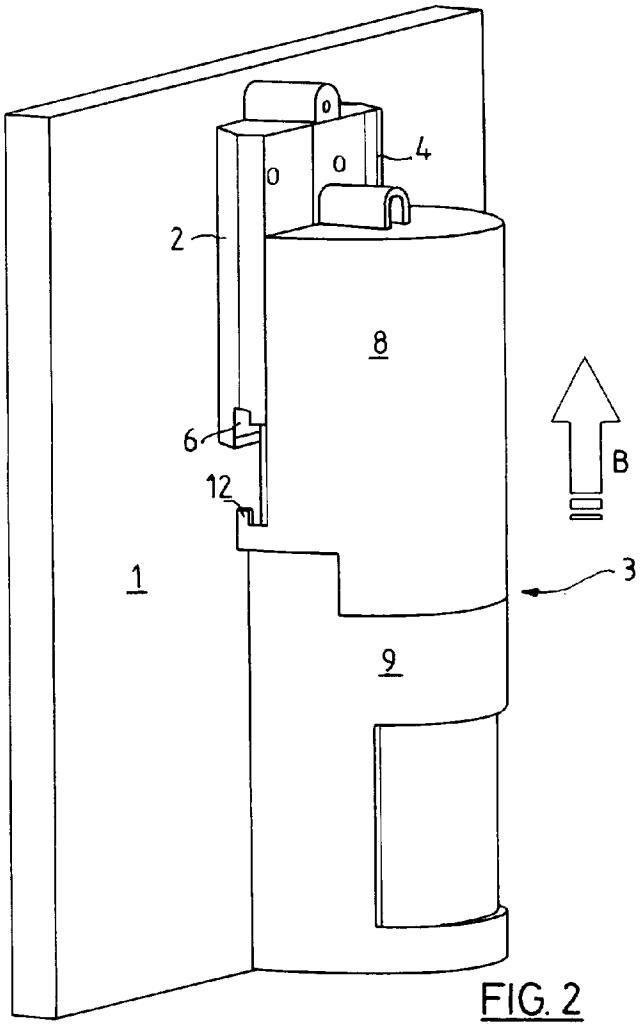
FIG. 2 illustrates a danger sensor in the assembled state being fixed to the mounting plate.
Figure 4:
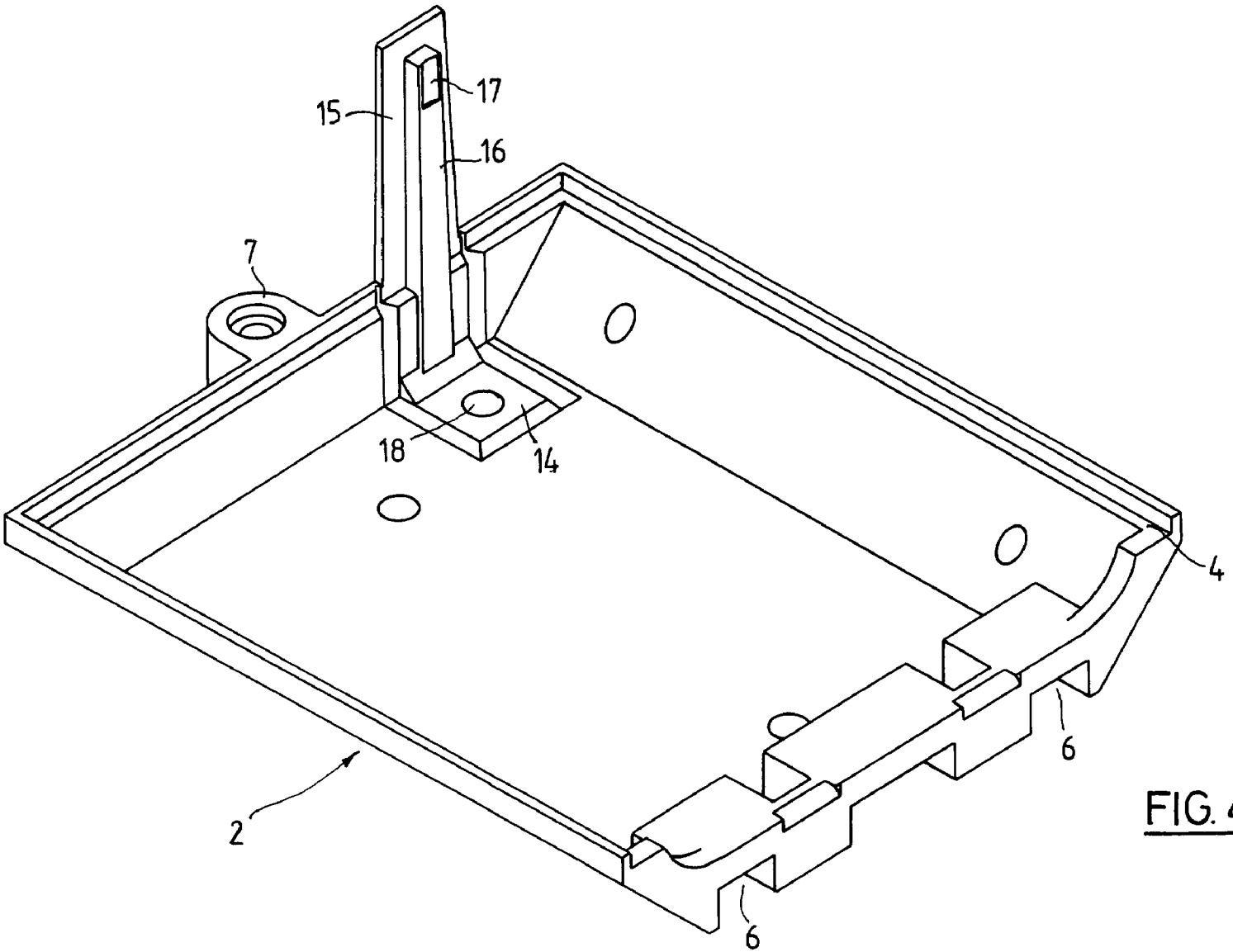
FIG. 4 illustrates a perspective view of the mounting plate.

FIGS. 1–3 show a part of a wall 1 with an attached mounting plate 2 for a danger sensor 3. The mounting plate 2 has a trough-like shape with a straight base and inclined side walls, and consequently is suitable for mounting both to a flat wall surface (holes for fixing screws in the base) and for corner installation (holes for fixing screws in the inclined side walls). The mounting plate 2 has on the front side of the side walls a guide profile 4. This is closed at the top by a face wall 5, and open at the base so that a counter-piece with a suitable guide groove can be inserted from below on the mounting plate 2. At the lower end, the mounting plate 2 has recesses 6 provided for engagement of corresponding locking lugs of the said counter-piece. The recesses 6 are shown diagrammatically in FIGS. 1 and 2; a detailed view is shown in FIG. 4. The top face wall 5 carries a web 7 which is intended for a fixing screw (not shown).

The danger sensor 3 consists of two modules, a communication module 8, and a detection module 9, where the latter is in the form of a passive infrared sensor (PIR). Instead of a PIR, the detection module can be formed by any movement or burglary sensor, fire sensor, glass breakage sensor, magnetic switch, or alarm sensor activated manually or a monitoring camera. The detection module 9 can also be a microphone to record noises, or a speaker for addressing a monitored room, or an alarm emitter such as for example a siren or light.

At its upper edge the detection module 9 has a step, which on its horizontal forward-facing surface carries a guide profile 10, and on its vertical surface a pin or socket element 11 of an electric plug connection. The guide profile 10 is part of a straight guide to connect the detection module 9 to the communication module 8. The communication module 8 has the same cross-section as the detection module 9, and at its lower edge has a step which is complementarily formed to the step of the detection module 9. On its horizontal surface, it also has a guide profile which forms part of the said straight guide, and on its vertical surface carries the counter piece to the pin or socket element 10 of the electric plug connector. At the base surface, two locking lugs 12 abut the step of the communication module 8 for engagement in recesses 6 of the mounting plate 2. The side edges of the communication module 8 have guide webs 13 which are provided for engagement in the guide profile 4 of the mounting plate 2. On the upper face of the communication module 8 is a web 14 with a bore to hold a fixing screw.

If a danger sensor 3 is to be installed in a monitored room, mounting plates 2 are screwed to the walls at the required points. Then each detection module 9 is connected with a communication module 8 to form a danger sensor 3 (moving the communication module 8 in direction of arrow A of FIG. 1, or detection module in the opposite direction). A mechanical connection between the two modules is created by the straight guide, and an electrical connection is created by the electric plug connector. The danger sensor 3, now in one piece, is connected to the mounting plate 2 as the guide webs 13 of the communication module 8 are directed from below into the guide profile 4 of the mounting plate 2 (FIG. 2, arrow B).

In the end position (FIG. 3), the locking lugs 12 of the communication module 8 engage in recesses 6 of mounting plate 2, whereby the danger sensor 3 can be attached to the mounting plate 2. The danger sensor 3 is then attached to the mounting plate 2 by means of a fixing screw inserted in a bore in web 14 of communication module 8, and screwed into web 7 of mounting plate 2. In the installed position of danger sensor 3, the communication module 8 is attached to the mounting plate 2, and the communication module 8, because its step at the interface with the detection module 9 covers the step of the latter in the direction of the room to be monitored, secures the detection module 9 against unauthorized removal from the mounting plate 2.

It is essential that all communication modules 8 have substantially the same shape and dimensions so that each communication module 8 can be connected with any detection module 9, and be attached to a mounting plate 2. Only a single type of mounting plate 2 and a single type (in relation to mechanical aspects) of communication module 8 are used. With regard to their electrical properties the communication modules may differ for different types of detection module 9.

The relevant electrical properties of the danger sensor will depend on whether single or two-way communication is desired, and/or in which country the system is installed. For example for radio communication in security systems the European countries specify a frequency of 867 MHz; USA specifies a frequency of 900 MHz; and Australia specifies one of 700 MHz. It must also be noted that for certain types of detection modules, such as for example cameras and speakers/microphones, broadband communication will be necessary.

Because the danger sensor 3 is attached to the mounting plate 2 via the communication module 8 which is mechanically the same in all cases, the entire security system is greatly simplified with regard to installation. It is now no longer necessary that each sensor must be screwed to the wall individually with a differing number of screws of different lengths and thickness. Now, only the mounting plate need be screwed to the wall, and for which, a single type of screw, a single type of dowel, a single type of screwdriver, and a single drill size is sufficient. The installation of the danger sensor is thus as simple as possible and requires no tool apart from the screwdriver for the fixing screw.

To guard against unauthorized removal of the danger sensor 3 from the wall 1, a sabotage detector is provided which consists of a contact switch (not shown) arranged in the area of the upper face of the communication module 8, and an activation element for the contact switch. As can be seen in FIG. 4, on the base of the mounting plate 2 there is an area 14 which is surrounded by weak points and carries a forward-projecting finger-like tab 15 forming the activation element of the contact switch. The tab 15, facing the communication module 8, has a web 16 with a contact surface 17 which in the installed state of danger sensor 3 presses against and closes the contact switch of the communication module 8. The communication module at its upper face has a strip-like recess or cut-out which is covered by a flat tab 15 so that the contact surface 17 lies inside the communication module 8. In this way the contact switch is not accessible from the outside and cannot be manipulated. The area 14 carrying the tab 15 has a fixing hole 8 and is screwed to the wall 1 (FIG. 1).

If a saboteur tears the entire danger sensor including mounting plate from the wall, the area 14 with tab 15 will be broken out of the mounting plate and remain on the wall so that the contact switch is opened and a sabotage attempt will be indicated. When the danger sensor 3 is torn away from the mounting plate 2, the tab 15 will remain on the mounting plate and the contact switch will also be opened. The same applies if the sensor is removed by releasing the fixing screw (web 7, 14, FIG. 1). The mounting plate 2 cannot itself be unscrewed from the wall without first removing the sensor, where again a sabotage alarm would be triggered.

The embodiment of the mounting plate 2 and danger sensor 3 shown in the drawings is provided merely as an example and should not be understood as restricting the broad scope of the present invention.

We claim:

1. A danger sensor for a security system having a wireless communication, comprising a communication module and a detection module, where the communication module has a mechanical and electrical/electronic interface with the detection module, and by which the danger sensor is attached to a mounting plate, and wherein a contact switch is arranged on the communication module and which forms a part of a sabotage detector to trigger an alarm on unauthorized removal of the danger sensor or one of its modules from the wall.

2. The danger sensor according to claim 1, wherein the communication module has substantially the same dimensions and same shape for all applicable detection modules.

3. The danger sensor according to claim 1, wherein the interface comprises a mechanical connection means and an electrical plug connection.

4. The danger sensor according to claim 3, wherein the mechanical connection device has a straight guide and a stop which are structured and arranged so that on creation of the mechanical connection, the electrical plug connection is also created.

5. The danger sensor according to claim 4, wherein the mechanical connection device is arranged on steps designed to be complementary to the communication and detection modules, and wherein in the installed state of the danger sensor, the step of the detection module, is covered by a step of the communication module.

6. The danger sensor according to claim 1, wherein the communication module has guide means which can be directed into a corresponding straight guide of the mounting plate, and further comprising locking means for fixing the sensor to the mounting plate.

7. The danger sensor according to claim 1, wherein a web is attached to a wall carrying the mounting plate and broken-out of the mounting plate, which forms another part of the sabotage detector, and closes a contact switch on the danger sensor.

8. The danger sensor according to claim 1, having a mounting means which is adapted to engage a guide means on the communication module.

* * * * *